US008286555B2

(12) United States Patent
Wuensche et al.

(10) Patent No.: US 8,286,555 B2
(45) Date of Patent: Oct. 16, 2012

(54) DEFLAGRATION TO DETONATION TRANSITION DEVICE

(75) Inventors: Thomas J. Wuensche, Granbury, TX (US); James Barker, Mansfield, TX (US); Gayle Moritz, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/356,619

(22) Filed: Jan. 23, 2012

(65) Prior Publication Data

US 2012/0118447 A1 May 17, 2012

Related U.S. Application Data

(62) Division of application No. 12/643,988, filed on Dec. 21, 2009, now Pat. No. 8,161,880.

(51) Int. Cl.
*C06C 5/06* (2006.01)

(52) U.S. Cl. ..... 102/275.11; 102/275.1; 102/275.9; 102/308

(58) Field of Classification Search ..... 102/275.1, 102/275.9, 275.11, 308, 310
See application file for complete search history.

(56) References Cited

U.S. PATENT DOCUMENTS

| | | | |
|---|---|---|---|
| 4,735,145 | A | 4/1988 | Johnson et al. |
| 4,759,291 | A | 7/1988 | Barker et al. |
| 4,777,878 | A | 10/1988 | Johnson et al. |
| 4,920,883 | A | 5/1990 | Barker |
| 4,998,477 | A | 3/1991 | Barker |
| 5,889,228 | A | 3/1999 | Ewick et al. |
| 6,053,111 | A | 4/2000 | Motley |
| 6,408,759 | B1 | 6/2002 | Ewick et al. |
| 6,435,095 | B1 | 8/2002 | Menzel et al. |
| 6,467,415 | B2 | 10/2002 | Menzel et al. |
| 7,343,860 | B2 | 3/2008 | Michel et al. |
| 7,661,362 | B2 | 2/2010 | Hennings et al. |
| 7,987,787 | B1 | 8/2011 | Sudick |
| 8,042,471 | B2 | 10/2011 | Michel et al. |
| 8,161,880 | B2 | 4/2012 | Wuensche et al. |
| 2002/0088363 | A1 | 7/2002 | Menzel et al. |
| 2008/0011179 | A1 | 1/2008 | Michel et al. |
| 2010/0031841 | A1 | 2/2010 | Michel et al. |
| 2010/0180786 | A1 | 7/2010 | Goodridge et al. |
| 2011/0146517 | A1 | 6/2011 | Wuensche et al. |

OTHER PUBLICATIONS

Office Action—Restriction dated Apr. 11, 2012, U.S. Appl. No. 13/356,625, filed Jan. 23, 2012.

Wuensche, Thomas J., et al., Patent Application entitled, "Deflagration to Detonation Transition Device," filed Jan. 23, 2012, U.S. Appl. No. 13/356,625.

"Explosive material," Wikipedia, http://en.wikipedia.org/w/index.php?title=Explosive_material (accessed and printed Jul. 2, 2009).

(Continued)

*Primary Examiner* — Michael David
(74) *Attorney, Agent, or Firm* — Conley Rose, P.C.

(57) ABSTRACT

A detonator assembly is provided. The detonator assembly comprises a deflagration to detonation transition body, a first thermally stable secondary explosive contained by the body, and a bulkhead coupled to the deflagration to detonation transition body. The bulkhead contains pressure within the body associated with firing the detonator assembly at least until a transition from a deflagration operation mode of the detonator assembly to a detonation operation mode of the detonator assembly has occurred. A second thermally stable secondary explosive may alternatively be included in the deflagration to detonation transition body, either separated from the first thermally stable secondary explosive or mixed with the first thermally stable secondary explosive. The detonator assembly comprises effectively no primary explosive.

20 Claims, 7 Drawing Sheets

OTHER PUBLICATIONS

"Primary and secondary explosives," Wikipedia, http://en.wikipedia.org/w/index.php?title=Primary_and_secondary_explosives (accessed and printed May 21, 2009).

"Safety testing of explosives," Wikipedia, http://en.wikipedia.org/w/index.php?title=Safety_testing_of_explosives (accessed and printed Jul. 1, 2009).

Office Action Restriction dated Nov. 1, 2011, U.S. Appl. No. 12/643,988, filed Dec. 21, 2009.

Notice of Allowance dated Dec. 27, 2011, U.S. Appl. No. 12/643,988, filed Dec. 21, 2009.

Notice of Allowance dated Jul. 24, 2012, U.S. Appl. No. 13/356,625 filed on Jan. 23, 2012.

DEFLAGRATION TO DETONATION TRANSITION DEVICE

CROSS-REFERENCE TO RELATED APPLICATIONS

This application is a divisional of and claims priority under 35 U.S.C. §120 to U.S. patent application Ser. No. 12/643,988, filed Dec. 21, 2009, entitled "Deflagration to Detonation Transition Device," by Thomas J. Wuensche, et al., which is incorporated herein by reference for all purposes. This application is also related to U.S. patent application Ser. No. 13/356,625, filed Jan. 23, 2012, entitled "Deflagration to Detonation Transition Device," by Thomas J. Wuensche, et al., which is a continuation of U.S. patent application Ser. No. 12/643,988, filed Dec. 21, 2009, entitled "Deflagration to Detonation Transition Device," by Thomas J. Wuensche, et al., both of which are incorporated herein by reference in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

High explosives and exploding devices are employed in a wide variety of commercial applications, for example, in mining, in hydrocarbon production, in building demolition, and in other applications. A high explosive may be categorized as either a primary explosive or a secondary explosive. Primary explosives are highly sensitive to stimuli such as impact, friction, heat, and/or electrostatic charges; secondary explosives are less sensitive to stimuli. Those skilled in the art often use the sensitivity of PETN (Pentaerythritol Tetranitrate) explosive as a benchmark. Primary explosives may be identified as explosives that are more sensitive than PETN, and secondary explosives may be identified as explosives that are less sensitive than PETN. Explosives may be additionally characterized by a variety of different parameters including sensitivity to impact, thermal stability, ability to dent a standard metal plate when detonated, crystal size, shape, and other parameters.

Explosives may take a variety of forms including liquids, gels, plastics, and powders. Explosive powders may be compressed to form dense pellets and/or shaped explosive charges. Explosives may comprise percentages of other non-explosive materials, for example, sawdust, powdered silica, diatomaceous earth, plastics, polymers, waxes, and other non-explosive materials. These additional non-explosive materials may contribute to stabilizing an otherwise overly sensitive explosive. The additional non-explosive materials may bind an explosive compound and promote ease of shaping a quantity of the explosive.

High explosives may be said to exhibit two modes of activity—a deflagration mode and a detonation mode. Deflagration may be referred to as a high reaction rate combustion, although the rate is subsonic compared to the speed of sound in the explosive. Detonation may be referred to as a very high reaction rate explosion. During detonation, the reaction propagates through the explosive material in excess of the speed of sound of the subject explosive material. Primary explosives generally may transition substantially immediately to detonation mode upon activation, that is, they have very short run-up distances to detonation. Secondary explosives may first activate in the deflagration mode and may later transition to the detonation mode. In secondary explosives, the run-up distance to detonation is generally longer than for primary explosives.

Commercial applications of high explosives are subject to many regulations and practical constraints. Some high explosives may be subject to United States export restrictions that forbid or limit those nations to which a device employing the high explosive may be shipped. Some high explosives may be subject to United States Department of Transportation (DOT) regulations that forbid or limit the transportation of devices employing the high explosive over public roadways, over public waterways, and/or via common carrier commercial airline flights. Businesses that use high explosives may be constrained by their commercial insurance policies and by the advice of legal counsel with reference to managing liabilities. Not least, prudent considerations for providing safe working conditions constrains the manner of using high explosives and the design of devices incorporating high explosives.

SUMMARY

In an embodiment, a detonator assembly is disclosed. The detonator assembly comprises a deflagration to detonation transition body, a first thermally stable secondary explosive contained by the body, and a bulkhead coupled to the deflagration to detonation transition body. The bulkhead contains pressure within the body associated with firing the detonator assembly at least until a transition from a deflagration operation mode of the detonator assembly to a detonation operation mode of the detonator assembly has occurred. The detonator assembly comprises effectively no primary explosive.

In another embodiment, a composition of explosives is disclosed. The composition of explosives comprises a first layer comprising a first thermally stable secondary explosive that is less sensitive than PETN explosive. The composition of explosives further comprises a second layer comprising the first thermally stable secondary explosive and a second thermally stable secondary explosive that is less sensitive than PETN explosive. The first explosive is more sensitive than the second explosive. The first explosive and the second explosive are mixed. The second layer contains effectively no primary explosive. The composition of explosives further comprises a third layer of the second explosive packed and unmixed. The second layer is disposed between the first layer and the third layer, the first layer is in intimate contact with the second layer, and the second layer is in intimate contact with the third layer.

In an embodiment, a detonator is provided. The detonator comprises a deflagration to detonation transition body and an initiator coupled to a first opening of the body. The detonator further comprises a first thermally stable secondary explosive and a second thermally stable secondary explosive, wherein the first and second thermally stable secondary explosives are mixed and contained within the body. The detonator further comprises a booster assembly coupled to a second opening of the body, wherein the booster assembly comprises a packed thermally stable secondary explosive, and a bulkhead to retain the initiator assembly coupled to the first opening at least until a transition of the mixture of first and second thermally stable secondary explosives to detonation occurs during firing of the detonator. The detonator comprises effectively no primary explosive.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
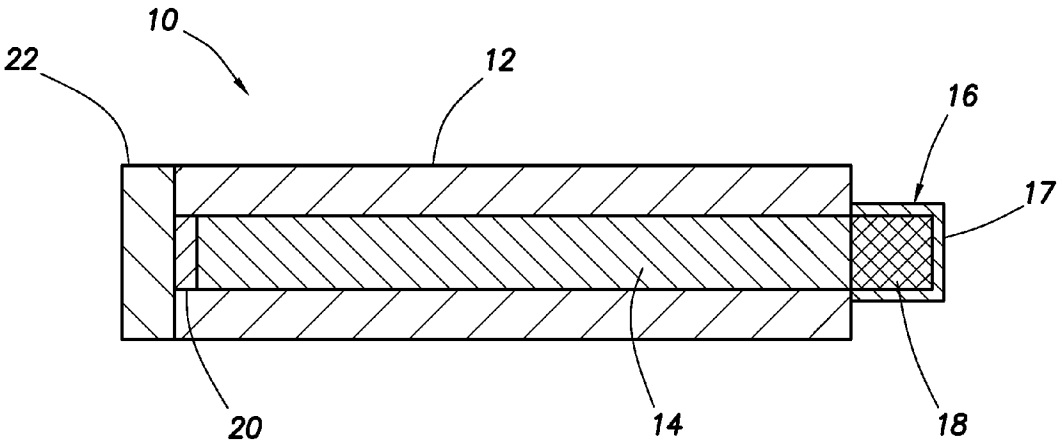
FIG. 1 is an illustration of an embodiment of a deflagration to detonation transition detonator according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

The present disclosure teaches a detonator suitable for use in high temperature applications, as well as in other applications, that does not employ primary explosives. For example, and without limitation, the detonator may be employed to detonate a detonating cord to fire a perforation gun as part of wellbore completion operations directed to producing hydrocarbons from a subterranean formation. In some oilfield provinces, downhole temperatures of production zones may exceed 400 degrees Fahrenheit (F.). Some oilfield provinces are located in nations that are subject to United States export restrictions that constrain the export of detonators that use primary explosives. In an embodiment, a novel explosive composition taught by the present disclosure may be employed in the detonator taught by the present disclosure. Those skilled in the art will appreciate that the detonator and the explosive composition taught by the present disclosure may be advantageously employed in a wide range of applications, not just in the exemplary embodiment of an oilfield downhole detonator and not just in high temperature applications. For example, while the detonator taught by the present disclosure may be operated in some high temperature applications where other detonators may not be suitable, the detonator of the present disclosure may also be used successfully in lower temperature environments.

In an embodiment, the detonator is of a deflagration to detonation transition (DDT) detonator type. A DDT detonator comprises a pressure containment body that may contain an explosive and an initiator. The initiator activates the explosive in the deflagration mode. As the explosive combusts, and the flame front in the explosive propagates, pressure and temperature increases within the pressure containment body, increasing the stimulus to the explosive until the explosive transitions from the deflagration mode to the detonation mode. While the flame front propagation and the transition from deflagration to detonation occur rapidly in general purpose secondary explosives, in thermally stable secondary explosives the transition from deflagration to detonation may occur relatively more slowly.

For purposes of the present disclosure, the term thermally stable secondary explosive refers to a family of secondary explosives that exhibit thermal stability when maintained at a temperature of at least 400 degrees F. for a time duration of at least one hour. Thermal stability means that the explosive does not spontaneously go active at the subject temperature and that the explosive substantially retains its key explosive characteristics at the subject temperature, for example, its characteristic sensitivity and its characteristic energy yield. Included in this family are explosives such as, but not limited to, HNS, PYX, Tacot, ONT, BRX, DODECA, and NONA. The inventors have discovered that incorporating a modified bulkhead that is designed to provide containment for the initiator during the deflagration mode of operation to maintain pressure within the interior chamber of a DDT detonator for use with thermally stable secondary explosives and to avoid the initiator being blown out the back of the interior chamber, thus reducing pressure in the interior chamber, at least until the reaction has transitioned to the detonation mode, provides an improvement over previous designs for DDT detonators. Some thermally stable secondary explosives may exhibit thermal stability at about 425 degrees F. for over 100 hours, for example, for about 200 hours. Some thermally stable secondary explosives may exhibit thermal stability at about 450 degrees F. for at least an hour. Each of these examples of thermally stable secondary explosives are comprehended by the above definition of a thermally stable explosive, where the subject explosive retains its key explosive characteristics when maintained at a temperature of at least 400 degrees F. for a time duration of at least one hour.

In some contexts, the DDT detonator taught by the present disclosure may be referred to as a thermally stable DDT detonator. Alternatively, in some contexts the DDT detonator taught by the present disclosure may be referred to as a high temperature DDT detonator. It is understood, however, that the DDT detonator taught by the present disclosure—whether referred to as a thermally stable DDT detonator or as a high temperature DDT detonator—is not limited to being used in high temperature environments and is not limited to being used in applications that require the use of a thermally stable detonator.

In some embodiments of the thermally stable DDT detonator, the thermally stable secondary explosive comprises a mixture of a first thermally stable secondary explosive and a second thermally stable secondary explosive, where the first thermally stable secondary explosive is more sensitive than the second thermally stable secondary explosive, but in another embodiment of the thermally stable DDT detonator, the thermally stable secondary explosive may comprise the first thermally stable secondary explosive substantially unmixed. In some embodiments of the thermally stable DDT detonator, a layer of the first thermally stable secondary explosive unmixed with other explosive material is disposed between the initiator and the mixture of the first and second thermally stable secondary explosives. In an embodiment of the thermally stable DDT detonator, the first thermally stable secondary explosive may comprise at least 10% of the explosive material in the mixture of the first and second thermally stable secondary explosives. In another embodiment of the thermally stable DDT detonator, the first thermally stable secondary explosive may comprise at least 40% of the explosive material in the mixture of the first and second thermally stable secondary explosives. In another embodiment of the thermally stable DDT detonator, the first thermally stable secondary explosive may comprise at least 65% of the explosive material in the mixture of the first and second thermally stable secondary explosives. In another embodiment of the thermally stable DDT detonator, the first thermally stable secondary explosive may comprise between about 75% and 95% of the explosive material in the mixture of the first and second thermally stable secondary explosives. In another embodiment of the thermally stable DDT detonator, the first thermally stable secondary explosive may comprise between about 80% and 90% of the explosive material in the mixture of the first and second thermally stable secondary explosives. In another embodiment of the thermally stable DDT detonator, the first thermally stable secondary explosive may comprise between about 83% and 87% of the explosive material in the mixture of the first and second thermally stable secondary explosives. In other embodiments, yet other proportions may be employed.

Additionally, the present disclosure teaches a novel explosive composition that contains effectively no primary explosives and is suitable for use in high temperature applications. For example, the composition may include a first layer of a first thermally stable secondary explosive having a first sensitivity, a second layer of a mixture of the first thermally stable secondary explosive and a second thermally stable secondary explosive having a second sensitivity, where the first sensitivity is greater than the second sensitivity, and a packed third layer of the second thermally stable secondary explosive. Without limitation, in an embodiment, the first thermally stable explosive may be related to NONA and the second thermally stable secondary explosive may be related to HNS.

Turning now to FIG. 1, a first thermally stable DDT detonator 10 is described. The first DDT detonator 10 comprises a first deflagration to detonation transition (DDT) body 12, a first thermally stable secondary explosive 14, a booster assembly 16, an initiator 20, and a bulkhead 22. In an embodiment, the booster assembly 16 comprises a cup 17 and a packed thermally stable secondary explosive 18. The first thermally stable DDT detonator 10 contains effectively no primary explosives.

In an embodiment, the first thermally stable secondary explosive 14 and the packed thermally stable secondary explosive 18 may be defined to exhibit thermal stability at 400 degrees F. for at least one hour and to be less sensitive than PETN (Pentaerythritol Tetranitrate) explosive. In another embodiment, the first thermally stable secondary explosive 14 and the packed thermally stable secondary explosive 18 may be defined to exhibit thermal stability at 450 degrees F. for at least one hour and to be less sensitive than PETN. In another embodiment, the thermally stable secondary explosive 14 and the packed thermally stable secondary explosive 18 may be defined to exhibit thermal stability at 425 degrees F. for at least one hundred hours and to be less sensitive than PETN. As used herein, the term sensitive and/or sensitivity refer to responsiveness of an explosive to stimulus. More specifically, the term sensitivity may refer to the readiness of the explosive to be initiated and/or exploded in response to any of an impact shock, friction, shearing force, heat, static electricity, and electrical sparks.

In an embodiment, the first thermally stable secondary explosive 14 and the packed thermally stable secondary explosive 18 may be selected from one of NONA (2,2',2"-4,4',4"-6,6',6"-nonanitroterphenyl), HNS-I (where HNS is generally hexanitrostilbene), HNS-II, HNS-IV, BRX (1,3,5-trinitro-2,4,6-tripicrylbenzene), PYX (picrylaminodimitropyridine), Tacot (Tetranitrobenzotriazolo-benzotriazole), ONT (2,2',4,4',4",6,6',6" Octanitroterpheyl), DODECA (Dodecanitro-m,m'-quatraphenyl), and CL-20 (2,4,6,8,10,12-hexanitrohexaazaisowurtzitane). Other compositions having similar chemical properties and/or explosive characteristics, particularly having similar sensitivity and temperature stability, either existing or developed in the future, could likewise be used. Other compositions having similar chemical properties and/or explosive characteristics may be said to be related to these thermally stable secondary explosives. In an embodiment, the packed thermally stable secondary explosive 18 may be the same explosive as the first thermally stable secondary explosive 14.

In an embodiment, during assembly of the first thermally stable DDT detonator 10, the first thermally stable secondary explosive 14 may be introduced into an interior chamber of the first DDT body 12 in small increments. Between the introductions of small increments of the first thermally stable secondary explosive 14, the first DDT body 12 may be vibrated to promote the elimination of excess air between the particles of the first thermally stable secondary explosive 14. In some contexts, the packed thermally stable secondary explosive 18 may be referred to as a pellet of thermally stable secondary explosive. In an embodiment, the first thermally stable secondary explosive 14 and the packed thermally stable secondary explosive 18 may contain a small portion of non-explosive materials, for example, but not by way of limitation, polymers, waxes, or binders, to promote stability, handling, and/or shaping characteristics.

The cup 17 may be formed of any material suitable to retain the packed thermally stable secondary explosive 18 and to propagate detonation, for example, to propagate detonation to a detonating cord associated with a perforation gun. In an embodiment, the cup 17 may be formed of a thin metal material and be coupled to a nipple of the first DDT body 12, for example, by crimping the cup 17 onto the nipple. In other embodiments, however, the cup 17 may be formed of ceramic, plastic, threads, cloth, fiberglass, composite materials, or other non-metallic materials and/or coupled to the first DDT body 12 by other known retaining mechanisms, such as, but not limited to, by an adhesive, a rivet, a clip, a screw, a bolt, a pin, a weld, or a laser weld. In an embodiment, the cup 17 may be coupled to the first DDT body 12 by a snap fit. In an embodiment, the interior of the cup 17 may have surface irregularities, for example, ridges, stippling, and/or other surface irregularities, to promote adherence of the packed thermally stable secondary explosive 18 in the cup 17. In an embodiment, the cup 17 may have a variety of shapes and sizes and is not limited by the proportions represented in FIG. 1. In an embodiment, the first thermally stable DDT detonator 10 may not comprise the packed thermally stable secondary explosive 18, and the cup 17 may function to close the end of the first DDT body 12 and to retain the first thermally stable secondary explosive 14 within the first DDT body 12 and/or to exclude unwanted materials, for example, but not by way of limitation, wellbore circulation fluid, from the first thermally stable secondary explosive 14.

The first DDT body 12 may be formed of any high strength material suitable for substantially retaining the pressure generated by activation of the first thermally stable secondary explosive 14, at least until the reaction transitions to the detonation mode. In an embodiment the first DDT body 12 may be formed of a metal, such as, but not by way of limitation, steel, or a non-metal, such as, but not by way of limitation, ceramic, plastic, reinforced composite materials, or another high strength material. The first DDT body 12 defines the interior chamber that contains the first thermally stable secondary explosive 14 and the initiator 20. It is understood that FIG. 1 is not intended to represent relative dimensions and/or proportions of the first thermally stable DDT detonator 10. For example, in some embodiments, proportions among the thickness of the wall of the first DDT body 12, the diameter of the chamber defined by the first DDT body 12, and/or the length of the first DDT body 12 may be different from those illustrated in FIG. 1. In an embodiment, the first DDT body 12 is about 3 inches long, but in other embodiments the first DDT body 12 may have different lengths. In some embodiments, the first DDT body 12 is relatively longer than known DDT detonators, based on the first thermally stable secondary explosive 14 being generally less sensitive than explosives employed in known DDT detonators. It is contemplated that altering the shape of the interior chamber defined by the first DDT body 12, for example, tapering the interior chamber to narrow towards the booster assembly 16, may promote a more rapid transition to the detonation mode and may enable shortening the length of the first DDT body 12.

The initiator 20 generates a hot flame front to initiate deflagration of the first thermally stable secondary explosive 14. The initiator 20 may activate in response to external signals, including a pressure signal, an electrical signal, and/or another type of signal. For example, the initiator 20 may activate in response to a percussive impulse, for example, an impact from a firing pin. As an alternative example, the initiator 20 may activate in response to an electrical current, for example, but not by way of limitation, in response to a surge of current from a charged electrical capacitor. In an embodiment, the initiator 20 may comprise one of a semiconductor bridge (SCB), a primer, and a percussion cap. In an embodiment, the initiator 20 further comprises an energetic material, such as an insensitive pyrotechnic material, in intimate contact with the first thermally stable secondary explosive 14. As used herein, the term pyrotechnic refers to a material which burns but does not detonate. In an embodiment, the pyrotechnic material may comprise THKP (titanium hydride potassium perchlorate) pyrotechnic powder, TSPP (titanium subhydride potassium perchlorate) pyrotechnic material, TMAP-KP (tetramethylammonium perchlorate-potassium perchlorate) pyrotechnic material, or another pyrotechnic material. Each of these pyrotechnic materials are known to burn at a very high temperature, which is suitable for reliably initiating the deflagration of the first thermally stable secondary explosive 14.

The bulkhead 22 is coupled to the first DDT body 12 to confine and enhance pressure build-up during the deflagration to detonation transition. In some contexts the bulkhead 22 may be referred to as a plug or a cap. In an embodiment, the bulkhead 22 may be coupled to the first DDT body 12 by one of screws, bolts, rivets, adhesives, a locking ring, an interference fit, a snap fit, pins, and other like attaching hardware. In an embodiment, the bulkhead 22 may be coupled to the first DDT body 12 by threaded engagement between a threading of the bulkhead 22 and a thread of the first DDT body 12. In an embodiment, the bulkhead 22 may be coupled to the first DDT body 12 by welding and/or spot welding. In an embodiment, the bulkhead 22 may be coupled to the first DDT body 12 by fusing together some of the material of the bulkhead 22 with some of the material of the first DDT body 12, for example, using a laser welder and/or an ultrasound process.

In an embodiment, once the transition to detonation has occurred, the bulkhead 22 need no longer remain coupled to the first DDT body 12, because once detonation has been achieved in the first thermally stable secondary explosive 14 the detonation may continue to propagate independently of the bulkhead 22 confining and enhancing pressure build-up. Thus, in an embodiment, the bulkhead 22 may rupture or the coupling of the bulkhead 22 to the first DDT body 12 may fail after detonation of the first thermally stable secondary explosive 14 is achieved. In an embodiment, the bulkhead 22 and the coupling of the bulkhead 22 to the first DDT body 12 are designed to contain pressure substantially within the interior chamber after activation of the first thermally stable secondary explosive 14 and until the deflagration to detonation transition occurs. In an embodiment, the bulkhead 22 and the coupling are designed to contain pressure substantially within the interior chamber for at least 0.5 microsecond (500 nanoseconds) after activation of the first thermally stable secondary explosive 14. In an embodiment, the bulkhead 22 and the coupling are designed to contain pressure substantially within the interior chamber for at least 1 microsecond after activation of the first thermally stable secondary explosive 14. In an embodiment, the bulkhead 22 and the coupling are designed to contain pressure substantially within the interior chamber for at least 10 microseconds after activation of the first thermally stable secondary explosive 14. In an embodiment, the bulkhead 22 and the coupling are designed to contain pressure substantially within the interior chamber for at least 100 microseconds after activation of the first thermally stable secondary explosive 14. In an embodiment, the bulkhead 22 and the coupling are designed to contain pressure substantially within the interior chamber for at least 1 millisecond after activation of the first thermally stable secondary explosive 14. In an embodiment, the bulkhead 22 and the coupling are designed to withstand a pressure of at least 50 pounds per square inch (PSI) applied to the bulkhead 22. In an embodiment, the bulkhead 22 and the coupling are designed to withstand a pressure of at least 100 PSI applied to the bulkhead 22. In an embodiment, the bulkhead 22 and the coupling are designed to withstand a pressure of at least 200 PSI applied to the bulkhead 22. In an embodiment, the bulkhead 22 and the coupling are designed to withstand a pressure of at least 500 PSI applied to the bulkhead 22. In an embodiment, the bulkhead 22 and the coupling are designed to withstand a pressure of at least 1000 PSI applied to the bulkhead 22. In an embodiment, the bulkhead 22 and the coupling are designed to withstand a pressure of at least 5000 PSI applied to the bulkhead 22. In an embodiment, the bulkhead 22 and the coupling are designed to withstand a pressure of at least 10000 PSI applied to the bulkhead 22.

Figure 2:
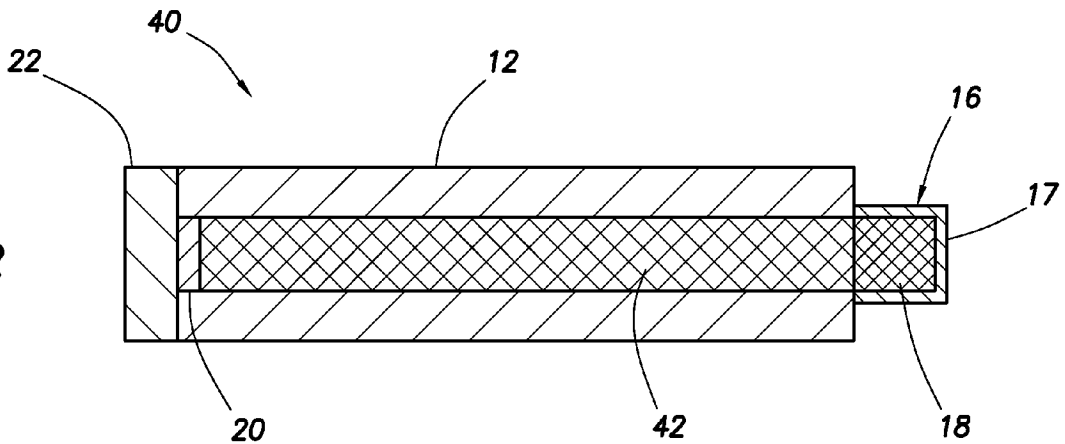
FIG. 2 is an illustration of an embodiment of a deflagration to detonation transition detonator according to an embodiment of the disclosure.

Turning now to FIG. 2, a second thermally stable DDT detonator 40 is described. In an embodiment, the second thermally stable DDT detonator 40 is substantially similar to the first thermally stable DDT detonator 10 described above, with the exception that rather than the first thermally stable secondary explosive 14, the first DDT body 12 contains a mixture of two different thermally stable secondary explosives 42. The second thermally stable DDT detonator 40 contains effectively no primary explosives.

In an embodiment, during assembly of the second thermally stable DDT detonator 40, the mixture of explosives 42 may be introduced into the interior chamber in small increments. Between the introductions of small increments of the mixture of explosives 42, the first DDT body 12 may be vibrated to promote the elimination of excess air between the particles of the mixture of explosives 42. In an embodiment, the mixture of explosives 42 may comprise a second thermally stable secondary explosive and a third thermally stable secondary explosive. In an embodiment, the second thermally stable secondary explosive and the third thermally stable secondary explosive may be defined to exhibit thermal stability at 400 degrees F. for at least one hour and to be less sensitive than PETN explosive. In another embodiment, the second thermally stable secondary explosive and the third thermally stable secondary explosive may be defined to exhibit thermal stability at 450 degrees F. for at least one hour and to be less sensitive than PETN. In another embodiment, the second thermally stable secondary explosive and the third thermally stable secondary explosive may be defined to exhibit thermal stability at 425 degrees F. for at least one hundred hours and to be less sensitive than PETN.

In an embodiment, the second thermally stable secondary explosive may comprise from 10% to 98% of the mixture of explosives 42. In another embodiment, the second thermally stable secondary explosive may comprise from 65% to 98% of the mixture of explosives 42. In another embodiment, the second thermally stable secondary explosive may comprise from 75% to 95% of the mixture of the explosives 42. In another embodiment, the second thermally stable secondary explosive may comprise 80% to 90% of the mixture of the explosives 42. In another embodiment, the second thermally stable secondary explosive may comprise 83% to 87% of the mixture of the explosives 42. In an embodiment, the second thermally stable secondary explosive comprises NONA or an explosive related to NONA. In an embodiment, the third thermally stable secondary explosive comprises HNS-I, HNS-II and/or HNS-IV. In an embodiment, the third thermally stable secondary explosive comprises an explosive related to HNS-I, HNS-II, and/or HNS-IV.

Figure 3:
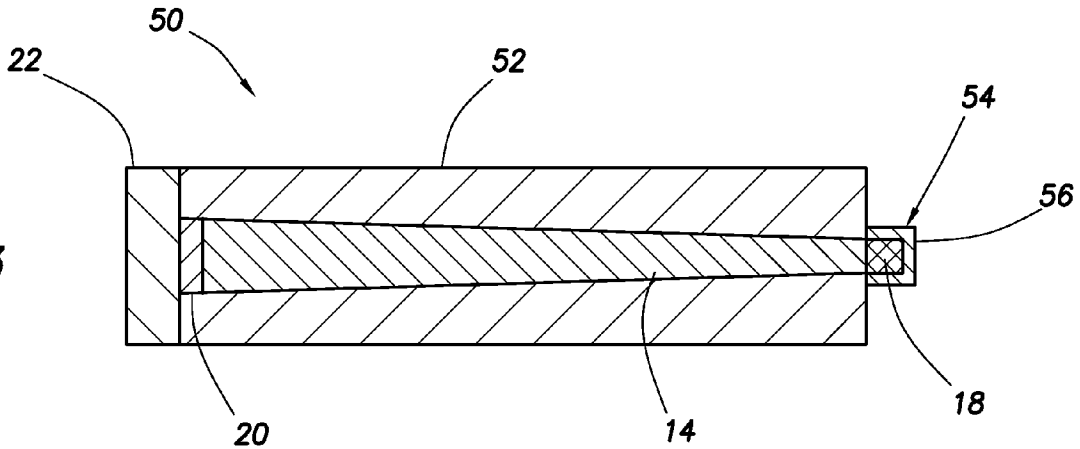
FIG. 3 is an illustration of an embodiment of a deflagration to detonation transition detonator according to an embodiment of the disclosure.

Turning now to FIG. 3 a third thermally stable DDT detonator 50 is described. In an embodiment, the third thermally stable DDT detonator 50 is substantially similar to either the first thermally stable DDT detonator 10 or the second thermally stable DDT detonator 40, with the exception that an interior chamber defined by a second DDT body 52 tapers, narrowing towards a second booster assembly 54. The second booster assembly 54 may comprise a second cap 56 and the packed thermally stable secondary explosive 18. In an embodiment, the third thermally stable DDT detonator 40 may not include the packed thermally stable secondary explosive 18, and the second cap 56 may be employed to retain the explosives within the second DDT body 52 and/or to exclude unwanted materials, such as wellbore circulation fluid, from the explosives. The tapered contour of the interior chamber of the second DDT body 52 may promote more rapid transition from deflagration mode to detonation mode and permit reducing the length of the third thermally stable DDT detonator 50. In an embodiment, the interior chamber of the second DDT body 52 tapers throughout the entire region containing the first thermally stable secondary explosive 14 or the mixture of explosives 42. In an embodiment, the taper may be linear. Alternatively, in another embodiment, the taper may be curved, for example, parabolic, the taper may be stair-stepped, or the taper may have a different geometry. The third thermally stable DDT detonator 50 contains effectively no primary explosives.

Figure 4:
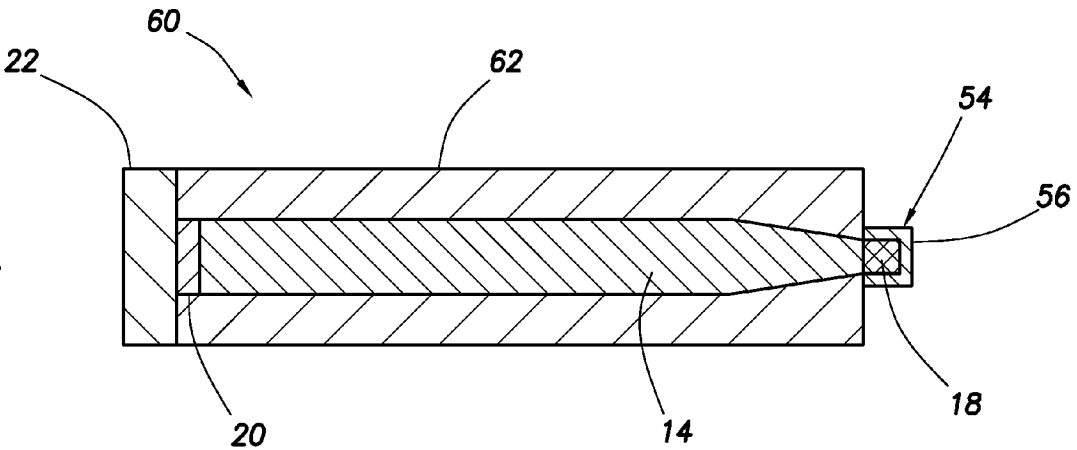
FIG. 4 is an illustration of an embodiment of a deflagration to detonation transition detonator according to an embodiment of the disclosure.

Turning now to FIG. 4 a fourth thermally stable DDT detonator 60 is described. In an embodiment, the fourth thermally stable DDT detonator 60 is substantially similar to the third thermally stable DDT detonator 50, with the exception that an interior chamber defined by a third DDT body 62 tapers only over a portion of the interior chamber proximate to the second booster assembly 54, for example, over the third of the interior chamber proximate to the second booster assembly 54, over a fourth of the interior chamber proximate to the second booster assembly 54, or over some other fraction of the interior chamber effective to promote more rapid transition from the deflagration mode to the detonation mode. In an embodiment, the fourth thermally stable DDT detonator 60 may not include the packed thermally stable secondary explosive 18, and the second cap 56 may be employed to retain the explosives within the third DDT body 62 and/or to exclude unwanted materials, such as wellbore circulation fluid, from the explosives. The taper of the interior chamber may be linear, curved, stair-stepped, or have some other geometry. The fourth thermally stable DDT detonator 60 may contain one of the first thermally stable secondary explosive 14 and the mixture of two different thermally stable secondary explosives 42. The fourth thermally stable DDT detonator 60 contains effectively no primary explosives.

Figure 5:
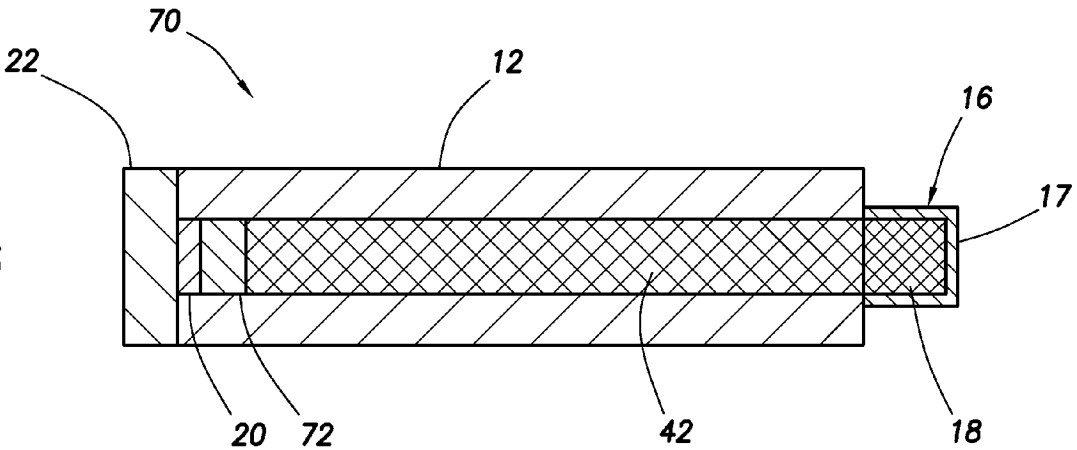
FIG. 5 is an illustration of an embodiment of a deflagration to detonation transition detonator according to an embodiment of the disclosure.

Turning now to FIG. 5, a fifth thermally stable DDT detonator 70 is described. The fifth thermally stable DDT detonator 70 is substantially similar to the second thermally stable DDT detonator 40, with the exception that a layer of the unmixed second thermally stable secondary explosive 72 is disposed between the initiator 20 and the mixture of explosives 42. The fifth thermally stable DDT detonator 70 contains effectively no primary explosives.

Figure 6:
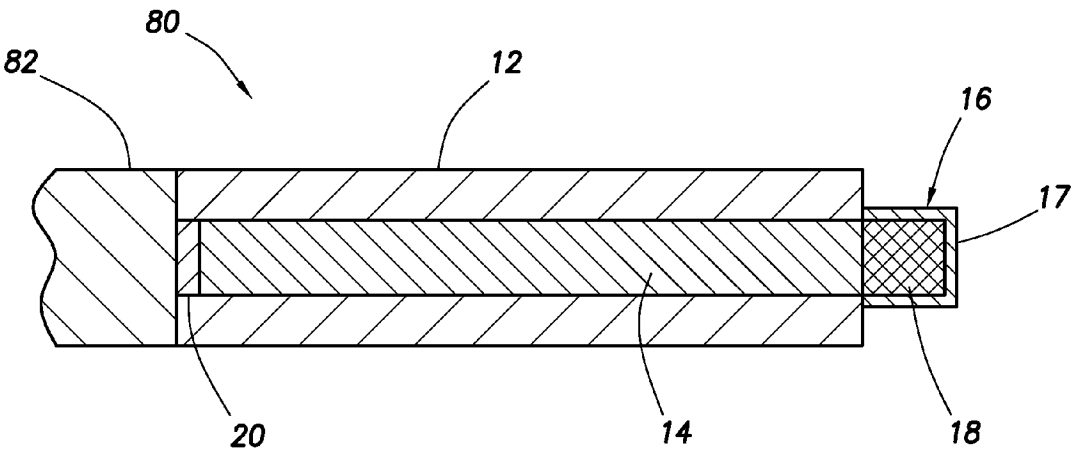
FIG. 6 is an illustration of an embodiment of a deflagration to detonation transition detonator according to an embodiment of the disclosure.

Turning now to FIG. 6, a sixth thermally stable DDT detonator 80 is described. The sixth thermally stable DDT detonator 80 is substantially similar to the first thermally stable DDT detonator 10, with the exception that the pressure retention functionality of the bulkhead 22 is provided instead by a subassembly 82 coupled to the sixth thermally stable DDT detonator 80, for example, threadingly coupled to the sixth thermally stable DDT detonator 80. In an embodiment, a mechanical structure or extension may project from the subassembly 82 to prop and/or support the initiator 20. In an embodiment, the sixth thermally stable DDT detonator 80 may contain the mixture of explosives 42 rather than the first thermally stable secondary explosive 14. The sixth thermally stable DDT detonator 80 contains effectively no primary explosives.

Figure 7:
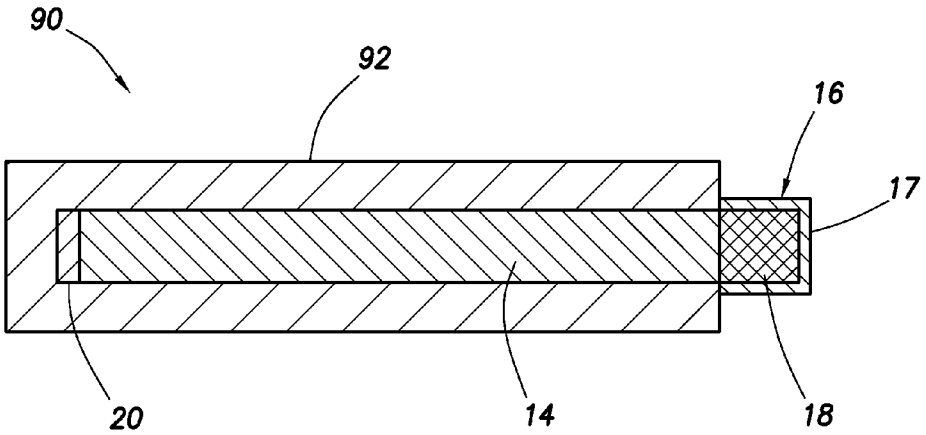
FIG. 7 is an illustration of an embodiment of a deflagration to detonation transition detonator according to an embodiment of the disclosure.

Turning now to FIG. 7, a seventh thermally stable DDT detonator 90 is described. The seventh thermally stable DDT detonator 90 is substantially similar to the first thermally stable DDT detonator 10, with the exception that a fourth DDT body 92 of the seventh thermally stable DDT detonator 90 is substantially closed at an initiator end, thereby avoiding the use of the bulkhead 22. In an embodiment, the initiator end of the fourth DDT body 92 may have one or more apertures to promote communication with the initiator 20, for example, to allow an electrical connection to the initiator 20 or to allow a firing pin to strike a primer or percussion cap of the initiator 20. In an embodiment, the seventh thermally stable DDT detonator 90 may contain the mixture of explosives 42 rather than the first thermally stable secondary explosive 14. The seventh thermally stable DDT detonator 90 contains effectively no primary explosives.

Figure 8:
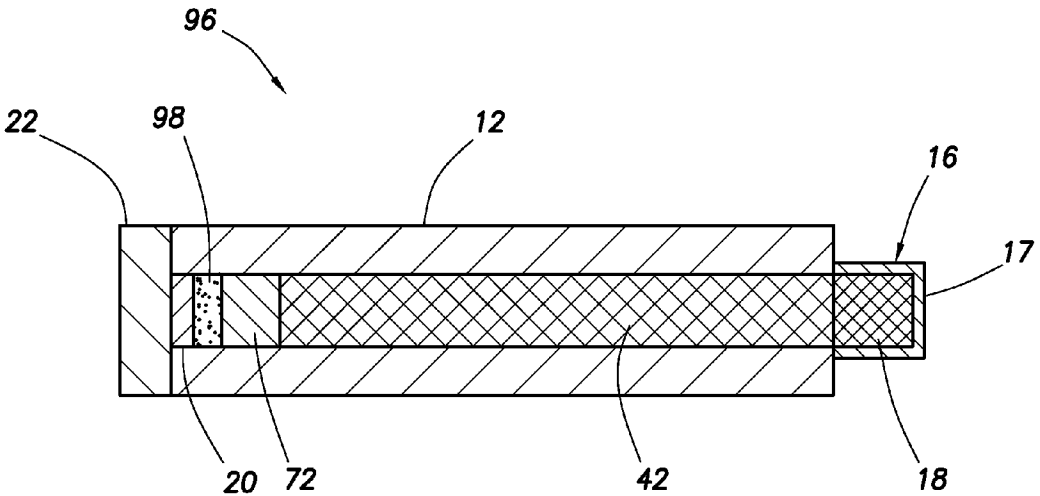
FIG. 8 is an illustration of an embodiment of a deflagration to detonation transition detonator according to an embodiment of the disclosure.

Turning now to FIG. 8, an eighth thermally stable DDT detonator 96 is described. The eighth thermally stable DDT detonator 96 is substantially similar to the fifth thermally stable DDT detonator 70, with the addition of a layer of pyrotechnic material 98 between the initiator 20 and the layer of the unmixed second thermally stable secondary explosive 72. The pyrotechnic material 98 is not an explosive and burns without detonating. In an embodiment, the pyrotechnic material 98 is selected to burn at a high temperature, thereby more reliably activating the layer of the unmixed second thermally stable secondary explosive 72. In an embodiment, the pyrotechnic material 98 may be one of THKP, TSSP, TMAP-KP, or another pyrotechnic material. The eighth thermally stable DDT detonator 96 contains effectively no primary explosives.

In some contexts herein, the thermally stable DDT detonator is said to contain "effectively no primary explosives" to provide for the possibility that some minute and unintentional quantities of primary explosives may be found in the secondary explosives. Such trace amounts of primary explosives may unintentionally infiltrate the secondary explosives by a variety of circumstances, some examples of which are described following. The primary explosives may be present as an unintended impurity of the manufacturing process, the depot handling process, and/or the field handling process. For example, an inconsiderable quantity of primary explosive may infiltrate the thermally stable DDT detonator by contamination from tooling or from the ambient manufacturing environment or from handling in a depot that includes other detonator devices that contain primary explosives. Alternatively, in an embodiment, a small amount of primary explosive may be present in a quantity that is insufficient to trigger transportation and/or export regulations directed to primary explosives. For example, in an embodiment, a small quantity of primary explosive—less than the quantity that invokes application of transportation and/or export regulations related to primary explosives—may be mixed into the thermally stable secondary explosive proximate to the booster assembly 16 to assure the transition from deflagration to detonation in worst case circumstances and thereby enhance the reliability of the thermally stable DDT detonator. In yet another embodiment, a small quantity of primary explosive, for example, but not by way of limitation, such as lead azide and/or silver azide, may be present in the initiator 20. In effect, the inclusion of such small quantities of primary explosives does not substantively change the novel principle of operation and the novel structure taught by the present disclosure.

It will be appreciated by those skilled in the art that a commercial detonator ought to be reliable. A detonator design that exhibits unpredictably variable behavior is dangerous, reduces customer satisfaction, and leads to lost time and money. Several aspects of the embodiments of the DDT detonators described above address enhancing the reliability of the DDT detonators for use in high temperature environments, for example, environments where the DDT detonator may be subjected to a temperature of at least 400 degrees F. for at least 1 hour.

Figure 9:
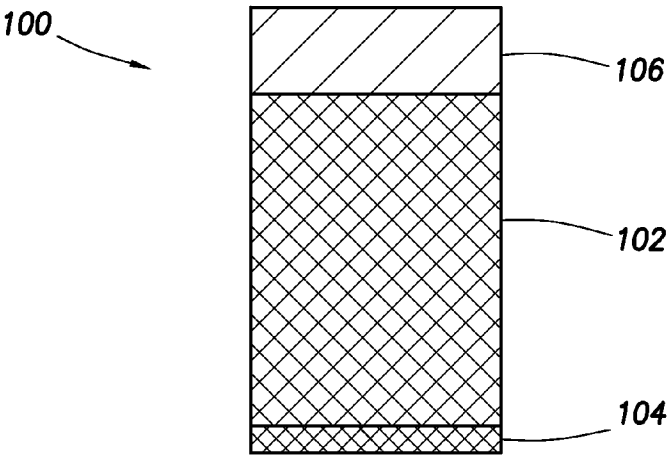
FIG. 9 is an illustration of a composition according to an embodiment of the disclosure.

Turning now to FIG. 9, a composition of thermally stable secondary explosives 100 is described. The composition 100 comprises a first layer of mixed thermally stable secondary explosives 102, a second layer of a packed thermally stable secondary explosive 104, and a third layer of unmixed thermally stable secondary explosive 106. In an embodiment, the first layer 102 comprises a mixture of two or more thermally stable secondary explosives selected from the list comprising NONA, HNS-I, HNS-II, HNS-IV, BRX, PYX, Tacot, ONT, DODECA, and CL-20. In an embodiment, the first layer 102 comprises a mixture of HNS-II and NONA. In an embodiment, the first layer 102 comprises a mixture of HNS-II, HNS-IV, and NONA. In an embodiment, the first layer 102 comprises a mixture of NONA and one or more of HNS-I, HNS-II and HNS-IV, wherein the NONA comprises from 10% to 98% of the mixture. In an embodiment, the first layer 102 comprises a mixture of NONA and one or more of HNS-I, HNS-II and HNS-IV, wherein the NONA comprises from 10% to 98% of the mixture. In another embodiment, the first layer 102 comprises a mixture of NONA and one or more of HNS-I, HNS-II and HNS-IV, wherein the NONA comprises from 40% to 98% of the mixture. In another embodiment, the first layer 102 comprises a mixture of NONA and one or more of HNS-I, HNS-II and HNS-IV, wherein the NONA comprises from 65% to 98% of the mixture. In another embodiment, the first layer 102 comprises a mixture of NONA and one or more of HNS-I, HNS-II and HNS-IV, wherein the NONA comprises from 75% to 95% of the mixture. In another embodiment, the first layer 102 comprises a mixture of NONA and one or more of HNS-I, HNS-II and HNS-IV, wherein the NONA comprises from 80% to 90% of the mixture. In another embodiment, the first layer 102 comprises a mixture of NONA and one or more of HNS-I, HNS-II and HNS-IV, wherein the NONA comprises from 83% to 87% of the mixture. In an embodiment, the second layer 104 comprises packed HNS explosive, for example, one or more of HNS-I, HNS-II and HNS-IV. Many other combinations are possible and are contemplated by the present disclosure. In an embodiment, the third layer 106 comprises unmixed explosive from the list comprising NONA, HNS-I, HNS-II, HNS-IV, BRX, PYX, Tacot, ONT, DODECA, and CL-20. In an embodiment, other thermally stable secondary explosives having similar chemical properties and/or explosive characteristics may be substituted for the NONA, HNS-I, HNS-II, and HNS-IV explosives above. For example, in an embodiment, a first thermally stable secondary explosive having a sensitivity about like that of NONA and having about the same amount of maximum power per unit volume as NONA may be substituted for NONA. In an embodiment, a second thermally stable secondary explosive having a sensitivity about like that of HNS-I, HNS-II and/or HNS-IV and having about the same amount of maximum power per unit volume as HSN-I, HNS-II and/or HNS-IV may be substituted for HNS-I, HNS-II and/or HNS-IV. It is thought that using a more sensitive thermally stable secondary explosive in the third layer 106 promotes better initiation of the composition 100.

In an embodiment, the composition 100 may be employed in combination with the thermally stable DDT detonator described in more detail above. One skilled in the art, however, will appreciate that the composition 100 may have applications in other structures and apparatuses. Additionally, although depicted in FIG. 9 in a columnar form, the composition 100 may be used in other shapes. Additionally, while the interfaces between the layers is illustrated as substantially straight, in another embodiment the interfaces between the layers may be curved or combinations of intersecting planes or non-planar.

A delay element may be introduced into any of the embodiments of the thermally stable DDT detonator described above. In embodiments having a delay element, an initiator and/or a pyrotechnic initiates a burning reaction in a delay column formed of a combustible material, such as, but not by way of limitation, a compacted tungsten powder or a tungsten powder mixture. In some contexts this delay column may be referred to as a fuse or as providing functionality similar to that of a fuse. The delay column burns, effecting a delay, until it reaches the secondary explosive mixture which then initiates and begins the deflagration to detonation reaction, as described above.

Figure 10:
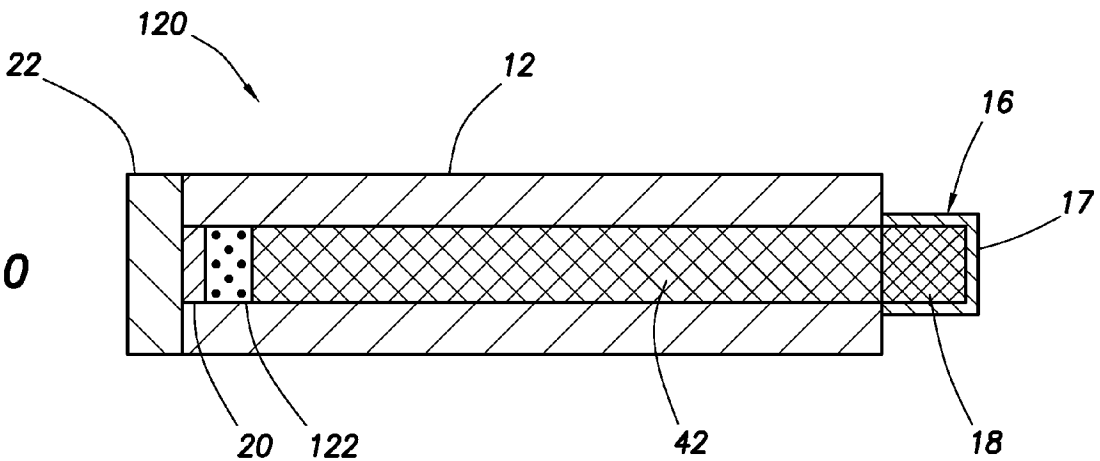
FIG. 10 is an illustration of an embodiment of a deflagration to detonation transition detonator according to an embodiment of the disclosure.

Turning now to FIG. 10, a ninth thermally stable DDT detonator 120 is described. In an embodiment, the ninth thermally stable DDT detonator 120 is substantially similar to the second thermally stable DDT detonator 40 described above, with the exception that a delay column 122 is placed between the initiator 20 and the mixture of two different thermally stable secondary explosives 42. The delay column 122 may also be referred to as combustible fuse material. In an embodiment, the delay column 122 may be comprised of tungsten powder, compacted tungsten powder, or other materials effective to propagate a flame front at a reduced rate relative to the flame front propagation rate in the secondary explosives 42. While the incorporation of a delay column into the second thermally stable DDT detonator 40 has been described, the present disclosure contemplates incorporation of a delay column into any of the other previously described thermally stable DDT detonators 10, 50, 60, 70, 80, 90, and 96.

Figure 11:
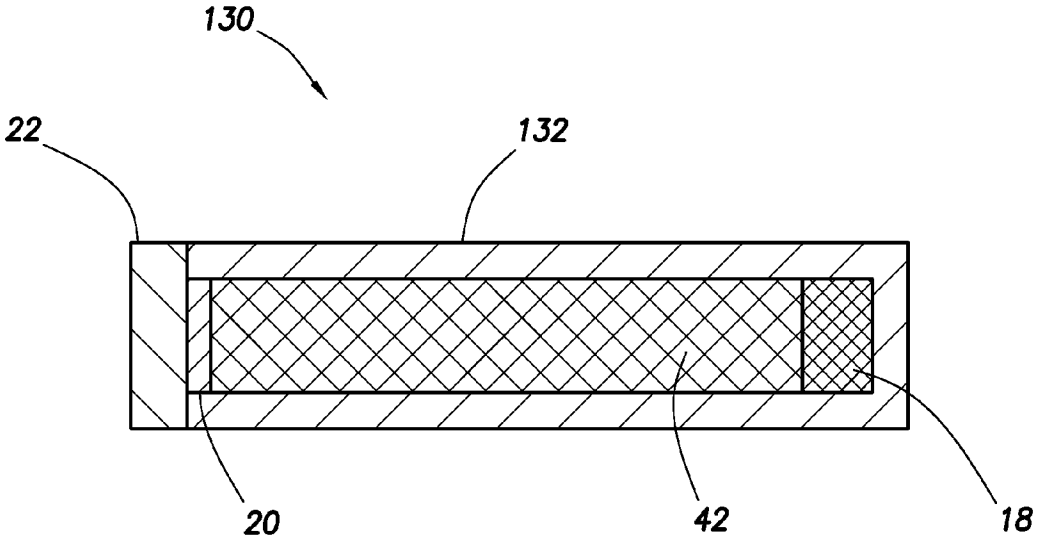
FIG. 11 is an illustration of an embodiment of a deflagration to detonation transition detonator according to an embodiment of the disclosure.

Turning now to FIG. 11, a tenth thermally stable DDT detonator 130 is described. In an embodiment, the tenth thermally stable DDT detonator 130 is substantially similar to the second thermally stable DDT detonator 40 described above, with the exception that the tenth thermally stable DDT detonator 130 comprises a fourth DDT body 132 that is open at a bulkhead end and closed at a packed thermally stable secondary explosive end. In an embodiment of the tenth thermally stable DDT detonator 130, the wall thickness of the fourth DDT body 132 may be thinner at the packed thermally stable secondary explosive end than along the sides containing the mixture of explosives 42. Alternatively, in another embodiment of the tenth thermally stable DDT detonator 130, the wall thickness of the fourth DDT body 132 may be substantially the same at packed thermally stable secondary explosive end as the wall thickness along the sides containing the mixture of explosives 42. In assembling the tenth thermally stable DDT detonator 130, the packed thermally stable secondary explosive 18 is first introduced into the open end of the fourth DDT body 132 and then packed into the closed end of the fourth DDT body 132. Then the mixture of explosives 42 is introduced into the open end of the fourth DDT body 132. Then the initiator 20 is installed. Then the bulkhead 22 is coupled to the fourth DDT body 132 to complete the assembly of the tenth thermally stable DDT detonator 130. In some embodiments, the closed end of the fourth DDT body 132 may promote sealing the tenth thermally stable DDT detonator 130 from undesired contact with fluids and/or pressures in the downhole environment. Additionally, in some embodiments, the closed end of the fourth DDT body 132 may protect the components of the tenth thermally stable DDT detonator 130, for example, the packed thermally stable secondary explosive 18, from mechanical hazards.

Figure 12:
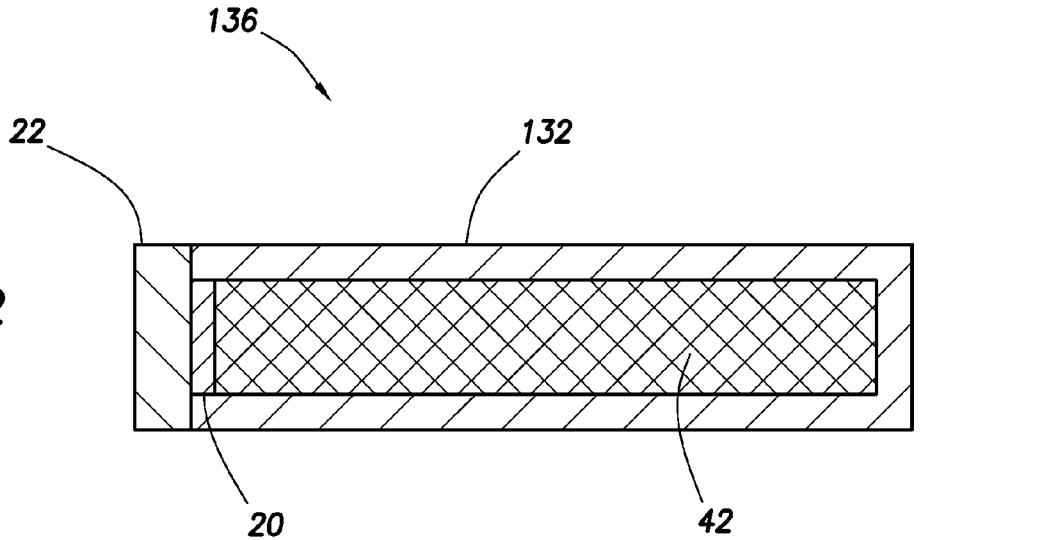
FIG. 12 is an illustration of an embodiment of a deflagration to detonation transition detonator according to an embodiment of the disclosure.

Turning now to FIG. 12, an eleventh thermally stable DDT detonator 136 is described. The eleventh thermally stable DDT detonator 136 is substantially similar to the tenth thermally stable DDT detonator 130, with the difference that the eleventh thermally stable DDT detonator 136 does not include the packed thermally stable secondary explosive 18. The packed thermally stable secondary explosive 18 of other embodiments may boost or amplify the amplitude of the detonation, but it is thought that, at least in some embodiments, such as in the eleventh thermally stable DDT detonator 136, the objective of propagating a detonation, for example, to a detonator cord in a perforation gun, may be achieved without the use of the packed thermally stable secondary explosive 18.

It will be appreciated that the fourth DDT body 132 may be combined with other embodiments and configurations of thermally stable DDT detonators described above. For example, in an embodiment, the mixture of explosives 42 contained in the tenth thermally stable DDT detonator 130 and/or in the eleventh thermally stable DDT detonator 136 may be replaced with the first thermally stable secondary explosive 14 of the first thermally stable DDT detonator 10. In an embodiment, the tapered interior chamber of the DDT body described in the third thermally stable DDT detonator 50 and/or the fourth thermally stable DDT detonator 60 may be combined with the tenth thermally stable DDT detonator 130 and/or in the eleventh thermally stable DDT detonator 136. Likewise, the tenth thermally stable DDT detonator 130 and/or the eleventh thermally stable DDT detonator 136 may comprise a layer of the unmixed second thermally stable secondary explosive 72 disposed between the initiator 20 and the mixture of explosives 42. Likewise, in an embodiment, the subassembly 82 described above with reference to FIG. 6 may replace the bulkhead 22 in the tenth thermally stable DDT detonator 130 and/or the eleventh thermally stable DDT detonator 136. In an embodiment, the tenth thermally stable DDT detonator 130 and/or the eleventh thermally stable DDT detonator 136 may comprise a layer of pyrotechnic material 98 between the initiator 20 and the mixed secondary explosive 42 or the layer of unmixed secondary explosive 72. In an embodiment, the tenth thermally stable DDT detonator 130 and/or the eleventh thermally stable DDT detonator 136 may comprise a delay column 122 as described above with reference to FIG. 10.

Figure 13:
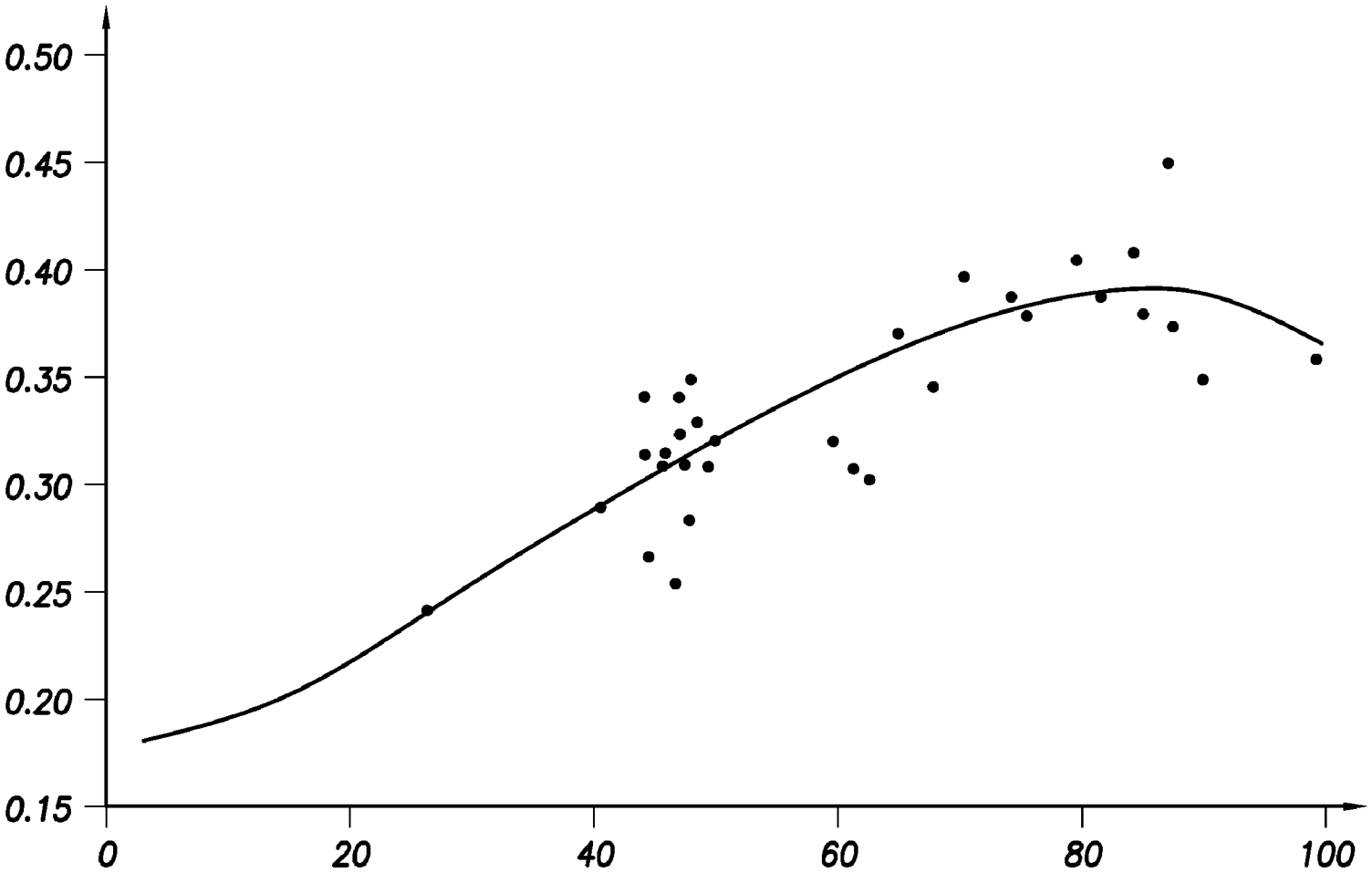
FIG. 13 is a graph of some preliminary test results.

Turning now to FIG. 13, results of some preliminary testing of some embodiments of the thermally stable DDT detonator are discussed. The horizontal axis of the chart depicted in FIG. 13 corresponds to the percentage of NONA secondary explosive in a mixture with HNS secondary explosive in the thermally stable DDT detonator, and the range of values represented on the horizontal axis is from 0% to 100%. The vertical axis of the chart depicted in FIG. 13 corresponds to inches of swell of the diameter of a detonation end of the thermally stable DDT detonator after detonation. The detonation end of the thermally stable DDT detonator may be opposite an initiator end of the thermally stable DDT detonator. Generally, the larger the swell of the diameter of the detonation end of the thermally stable DDT detonator after detonation, the more successful the test mixture. It is possible that mixtures of secondary explosives that are associated with greater swelling of the diameter of the detonation end of the thermally stable DDT detonator may be more reliable for use in downhole applications. The individual points on FIG. 13 represent specific tests conducted. The continuous curve represents the data points smoothed to fit a third order polynomial equation.

While various ratios of NONA secondary explosive mixed with HNS secondary explosive may be effective in the thermally stable DDT detonator, the graph in FIG. 13 suggests that a mixture comprising at least 40% NONA secondary explosive can produce desirable detonation results. Further, the graph in FIG. 13 suggests that the detonation results improve as the percentage of NONA secondary explosive in the mixture is increased to at least 65% of the mixture. While the data points and the third order polynomial curve indicate an optimum mixture in the range of about 80% to 90% NONA secondary explosive mixed with HNS secondary explosive, this interpretation should be tempered by appreciation for the limited number of tests performed. Without limitation, the third order polynomial curve suggests an optimum mixture in the range of 83% to 87% NONA secondary explosive mixed with HNS secondary explosive, but the use of other mixture ratios of NONA secondary explosive to HNS secondary explosive in the thermally stable DDT detonator are contemplated by the present disclosure.

While several embodiments have been provided in the present disclosure, it should be understood that the disclosed systems and methods may be embodied in many other specific forms without departing from the spirit or scope of the present disclosure. Additionally, one skilled in the art will readily appreciate that many of the distinctive features of the several described embodiments may advantageously be recombined in derivative embodiments that are equally contemplated by the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A composition of explosives, comprising:

a first layer comprising a first thermally stable secondary explosive that is less sensitive than PETN explosive;

a second layer comprising the first thermally stable secondary explosive; and a second thermally stable secondary explosive that is less sensitive than PETN explosive, where the first explosive is more sensitive than the second explosive, where the first explosive and the second explosive are mixed, and where the second layer contains effectively no primary explosive;

a third layer of the second explosive packed and unmixed, where the second layer is disposed between the first layer and the third layer, where the first layer is in intimate contact with the second layer, and where the second layer is in intimate contact with the third layer.

2. The composition of explosives of claim 1, wherein the first thermally stable secondary explosive comprises from 65% to 98% of the second layer.

3. The composition of explosives of claim 1, wherein the first thermally stable secondary explosive comprises from 75% to 95% of the second layer.

4. The composition of explosives of claim 1, wherein the first and second thermally stable secondary explosives are selected from the group consisting of NONA, HNS-I, HNS-II, HNS-IV, BRX, PYX, Tacot, ONT, DODECA, and CL20.

5. The composition of explosives of claim 1, wherein the first thermally stable secondary explosive is related to NONA, the second thermally stable secondary explosive is related to HNS, and the first thermally stable secondary explosive comprises from 65% to 98% of the second layer.

6. The composition of explosives of claim 1, wherein the first explosive is related to NONA, and wherein the first thermally stable secondary explosive comprises at least 40% of the second layer.

7. The composition of explosives of claim 1, wherein the first thermally stable secondary explosive is related to NONA, the second thermally stable secondary explosive is related to HNS, and the first thermally stable secondary explosive comprises from 10% to 98% of the second layer.

8. The composition of explosives of claim 7, wherein the second thermally stable secondary explosive is HNS-I, HNS-II, HNS-IV, or any combination thereof.

9. The composition of explosives of claim 1, wherein the second layer further comprises a third thermally stable secondary explosive.

10. The composition of explosives of claim 9, wherein the first thermally stable secondary explosive is related to NONA, the second thermally stable secondary explosive is related to HNS, and the third thermally stable secondary explosive comprises HNS-IV.

11. A composition of explosives, comprising:

a first layer comprising a first thermally stable secondary explosive;

a second layer comprising a mixture of the first thermally stable secondary explosive and a second thermally stable secondary explosive, wherein the first explosive is more sensitive than the second explosive;

a third layer comprising a third thermally stable secondary explosive, wherein the third layer is unmixed, wherein the second layer is disposed between the first layer and the third layer, and wherein the second layer is in contact with the first layer and the third layer.

12. The composition of claim 11, further comprising a fourth layer, wherein the fourth layer comprises a pyrotechnic material, and wherein the fourth layer is disposed in contact with the first layer.

13. The composition of claim 12, wherein the pyrotechnic material comprises titanium hydride potassium perchlorate, titanium subhydride potassium perchlorate, tetramethylammonium perchlorate-potassium perchlorate, or any combination thereof.

14. The composition of claim 11, wherein the second layer further comprises a fourth thermally stable secondary explosive in the mixture.

15. The composition of claim 14, wherein the fourth thermally stable secondary explosive comprises at least one explosive selected from the group consisting of: HNS-I, HNS-II, HNS-IV, an explosive related to HNS-I, an explosive related to HNS-II, and explosive related to HNS-IV, and any combination thereof.

16. The composition of claim 11, wherein the first thermally stable secondary explosive and the third thermally stable secondary explosive are the same.

17. The composition of claim 11, wherein the first thermally stable secondary explosive is less sensitive than the third thermally stable secondary explosive.

18. The composition of claim 11, further comprising a fourth layer, wherein the fourth layer comprises a metal powder, and wherein the fourth layer is disposed in contact with the first layer.

19. The composition of claim 18, wherein metal powder comprises tungsten powder.

20. The composition of claim 11, wherein the third thermally stable secondary explosive comprises an explosive selected from the group consisting of NONA, HNS-I, HNS-II, HNS-IV, BRX, PYX, Tacot, ONT, DODECA, and CL20.

* * * * *